US006116124A

United States Patent [19]

Ping

[11] Patent Number: 6,116,124

[45] Date of Patent: Sep. 12, 2000

[54] ADJUSTABLE PLIERS

[75] Inventor: Qiu Jian Ping, Hangzhou, China

[73] Assignee: Great Neck Saw Manufacturers, Inc., Mineola, N.Y.

[21] Appl. No.: 09/339,451

[22] Filed: Jun. 24, 1999

Related U.S. Application Data

[63] Continuation of application No. 08/909,645, Aug. 12, 1997.

[51] Int. Cl.[7] ..... B25B 7/04

[52] U.S. Cl. ..... 81/385; 81/319; 81/325; 81/337; 81/409.5; 81/411

[58] Field of Search ..... 81/318, 319, 325, 81/336, 337, 348, 352, 355, 358, 405, 407, 408, 409, 409.5, 411, 385

[56] References Cited

U.S. PATENT DOCUMENTS

| | | | |
|---|---|---|---|
| 1,136,618 | 4/1915 | Robinson | 81/407 X |
| 1,651,216 | 11/1927 | McGill . | |
| 4,802,390 | 2/1989 | Warheit | 81/407 X |
| 4,893,530 | 1/1990 | Warheit | 81/409.5 |
| 5,408,904 | 4/1995 | Neff | 81/360 |

FOREIGN PATENT DOCUMENTS

| | | | |
|---|---|---|---|
| 916413 | 1/1963 | United Kingdom | 81/324 |

*Primary Examiner*—James G. Smith
*Attorney, Agent, or Firm*—Joseph J. Previto

[57] ABSTRACT

Adjustable pliers having a pair of handles, each handle having a jaw portion, an intermediate portion and a hand-grip portion. The handles intersect each other and are pivotally mounted to each other so that movement of the hand-grip portions in one direction will move the jaw portions in the same direction. Holding means in the form of a pin extends from one of the intermediate portions and a slot is in the other intermediate portion. The holding pin extends into the slot and is slidable along the slot. The slot has receiving means in the form of notches which will receive the said holding pin when the jaw portions are placed in a predetermined position and hold them in that position. A locking assembly is also provided on the handle members to lock the two in position.

10 Claims, 4 Drawing Sheets

ADJUSTABLE PLIERS

This appication is a continuation of pending U.S. patent application Ser. No. 08/909,645 filed Aug. 12, 1997.

BACKGROUND

The present invention relates to adjustable pliers and more particularly to adjustable pliers which are adapted to be locked in a particular position.

A number of patents have issued on adjustable pliers. Applicant is aware of at least the following patents relating to adjustable pliers: U.S. Pat. Nos.
4,651,598
4,893,530
5,351,584
4,802,390
4,662,252
5,060,543

OBJECTS

The present invention is an improvement over adjustable pliers that have been used in the past and has for one of its objects the provision of an improved adjustable pliers which is capable of being easily locked in place around a work piece.

Another object of the present invention is the provision of an adjustable plier which can be locked in any position with one hand and which does not require the use of two hands.

Another object of the present invention is the provision of an improved adjustable plier which may be automatically locked in a position and automatically opened.

Another object of the present invention is the provision of an improved adjustable plier which may be locked easily in a particular position and easily unlocked from a particular position.

Another object of the present invention is the provision of an improved adjustable plier which is simple and inexpensive to manufacture and simple to use.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification wherein.

DESCRIPTION

Figure 1:
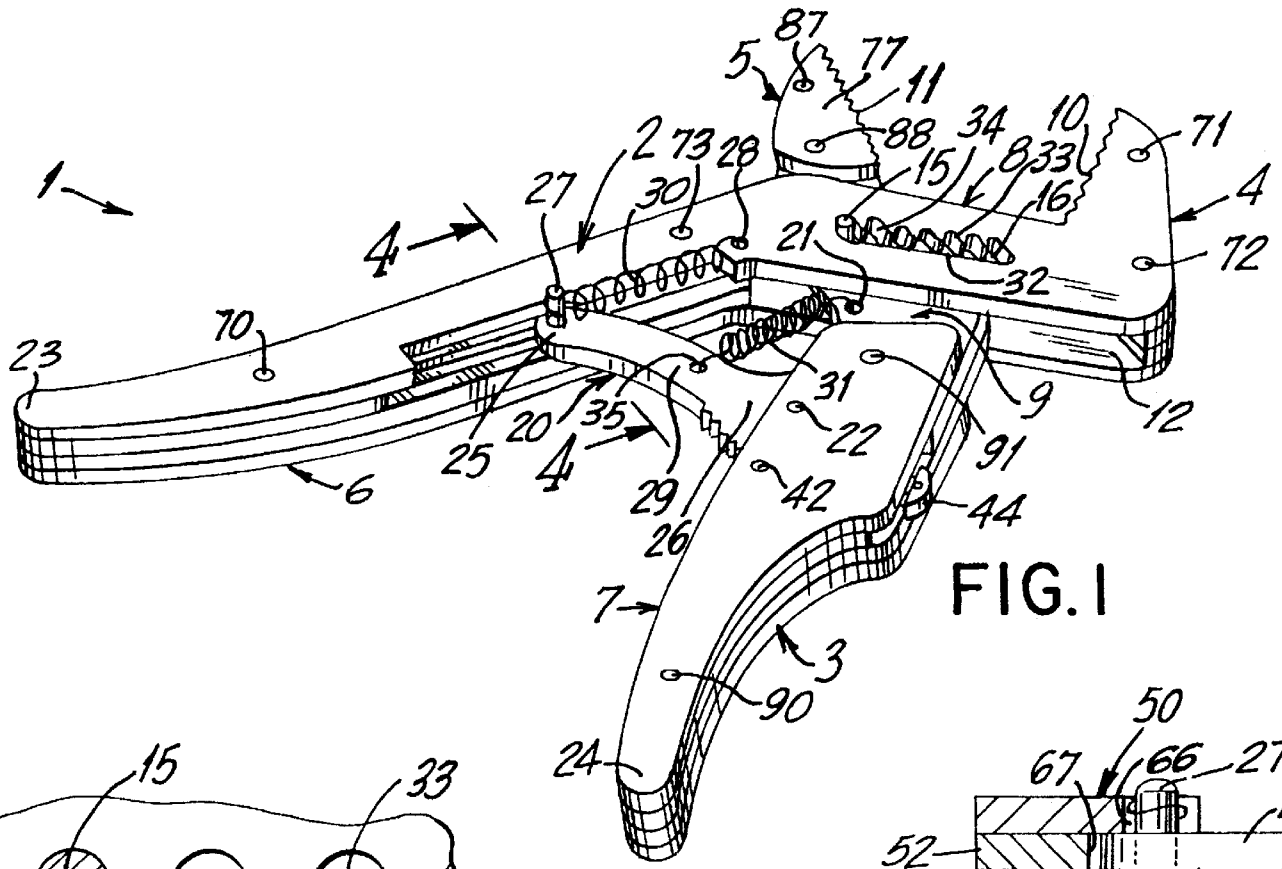
FIG. 1 is a perspective view showing the adjustable plier made in accordance with the present invention.
Figure 4:
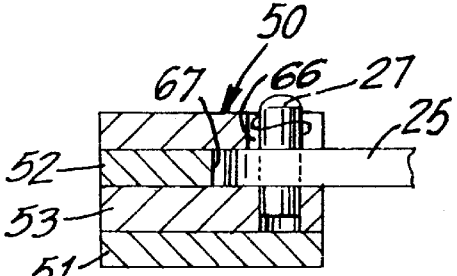
FIG. 4 is a sectional view taken along the line 4—4 of FIG. 1.
Figure 3:
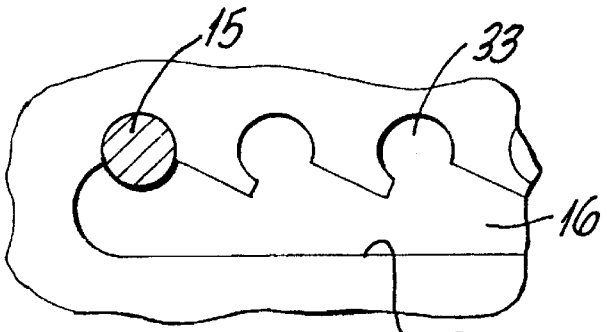
FIG. 3 is an enlarged plan view of a means for retaining the jaws in a particular position.

Referring to the drawings and more particularly to FIG. 1, the improved self-adjustable pliers 1 of the present invention comprises elongated first and second handle members 2 and 3 respectively. First and second handle member 2 and 3 each have jaw portions 4 and 5, spectively, hand grip portions 6 and 7, respectively, and intermediate neck portions 8 and 9, respectively, connecting the jaw portions 4–5 to the hand grip portions 6 and 7. The jaw portions 4–5 may be provided with a plurality of inner gripping teeth 10 and 11, if desired. The inner gripping teeth 10 and 11 have been shown in the drawings as being straight. However, the gripping teeth 10 and 11 may be curved or otherwise contoured, or they may be eliminated (i.e. no inner teeth on the jaw portions 4–5) without departing from the invention.

The first handle member 2 has an opening 12 in its neck portion 8 into and through which the neck portion 9 of the second handle member 8 is positioned so that jaw portions 4 and 5 and hand grip portions 6 and 7 are in juxtaposition to and opposite to each other. A pin 15 extends from each face of the neck portion 9 of the second handle number 3 and extends through a slot 16 in neck portion 8 of the first handle member 2, as will be discussed in greater detail hereinbelow, When the hand grips 6 and 7 are squeezed, the jaw portions 4 and 5 are moved toward each other as the handle members 2–3 pivot around the pin 15.

Figure 5:
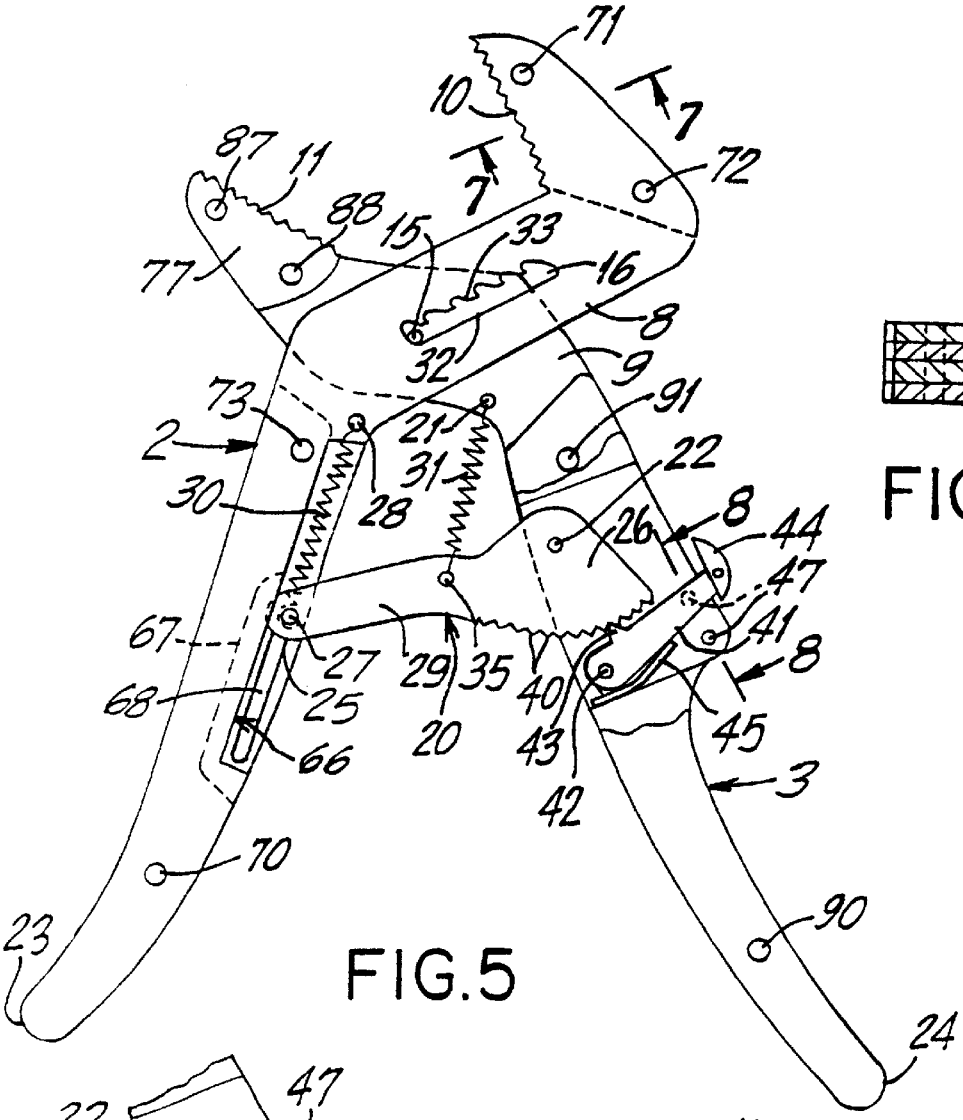
FIG. 5 is a plan view showing the adjustable plier in its open position.
Figure 7:
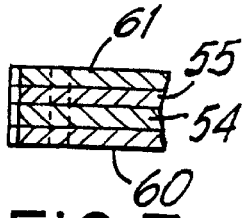
FIG. 7 is a sectional view taken along line 7—7 of FIG. 5.
Figure 9:
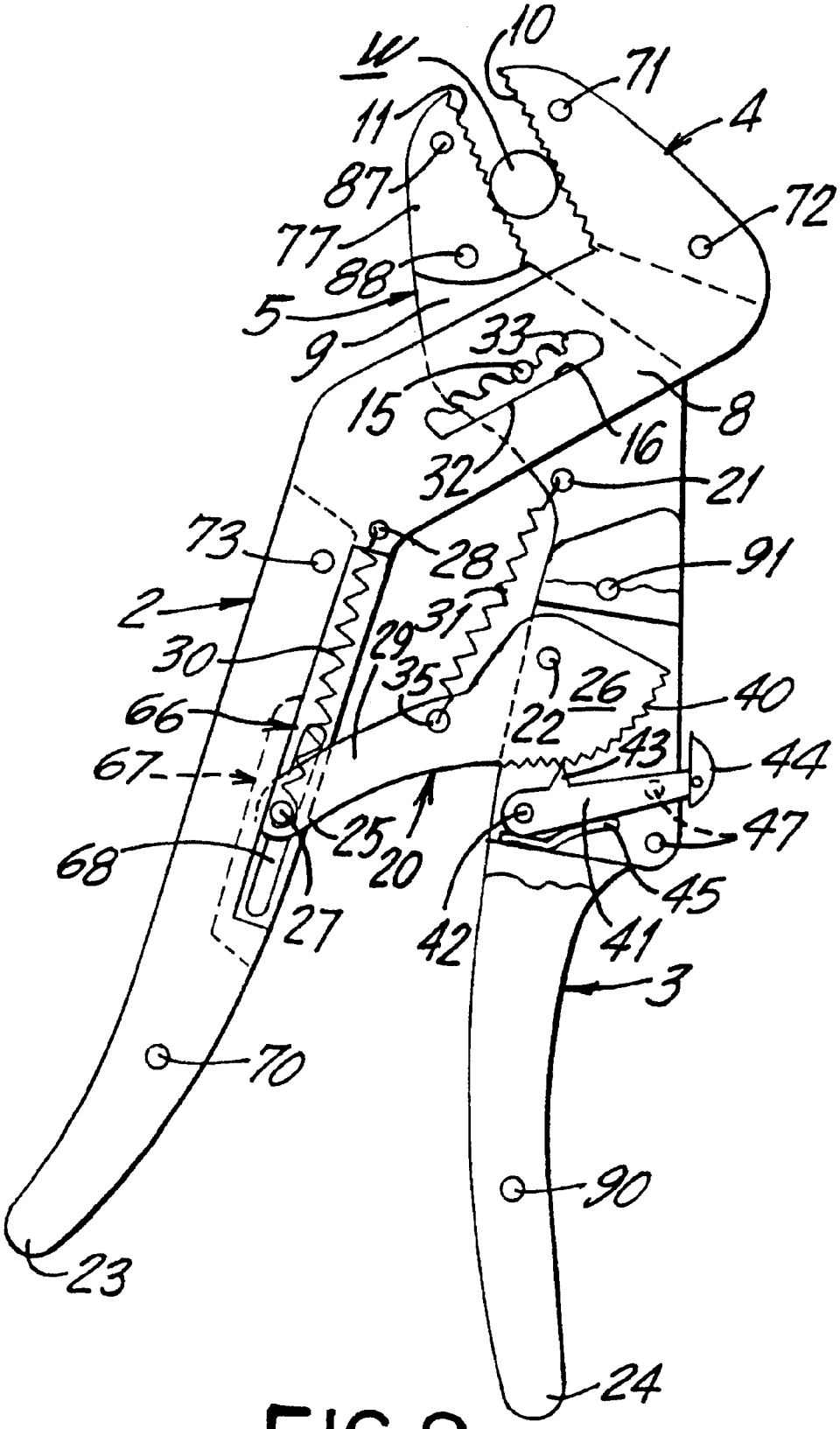
FIG. 9 is a plan view similar to FIG. 5 showing the jaws in their locked position around a work-piece.

A control arm 20 is pivotally mounted at each end to the hand grips 6 and 7 at a point between the neck portion 8 and 9 and the ends 23 and 24 of the hand grips 6–7. The control arm 20 has an end portion 25, a shank portion 29 and a head portion 26. In the drawing the end portion 25 is pivotally mounted to the first handle member 2 substantially midway between the neck portion 8 and the end 23 by a pin 27 extending from hand grip 6. The head portion 26 is larger than the end portion 25 and is pivotally mounted to the second handle member 3 by pin 22 at a point between the neck portion 9 and the end 24 of hand grip 7. It will be noted that with this arrangement when the jaws 4 and 5 are opened the control arm 20 is positioned in the position as shown in FIG. 5. When the jaws 4 and 5 are closed around a work piece W the control arm 20 is moved to the position as shown in FIG. 9.

A first spring member 30 connects the end 25 of the control arm 20 with the neck portion 8 of the first handle number 2 through pins 27 (around which one end is wrapped around) and opening 28 (into which the other end enters). A second spring member 31 connects the shank 29 of the control arm 20 to the neck portion 8 of the second handle member through openings 21 and 35. These springs 20 and 31 exert a contracting force which tends to keep the jaws 4 and 5 in their open position when the springs 30 and 31 are at rest. When the hand grips 6 and 7 squeezed to close the jaws 4 and 5 around a work piece W, the springs 30 and 31 are stretched. As soon as the hand grips 6 and 7 are released and unlocked, the springs 30 and 31 will contract and will open the jaws 4 and 5. As shown in the drawings the springs 30 and 31 are preferably located on the outside of the handle member 3 and 4 to permit easy access thereto for adjustment, repair, etc.

As will be described in greater detail hereinbelow, the slot 16 is shown as being on both sides of the neck portions 8 of the first handle member 2 with the neck portion 9 interposed therebetween. The pivot pin 15 extends through the elongated slot 16 on both sides of the neck portion 8 of the first handle member 2. The elongated slot 16 has one elongated straight, smooth edge 32 and a series of holding notches 33 on the opposite edge 34. When the jaws 4 and 5 are opening or closing, the pin 15 slides along the straight edge 32. When the jaws are to be held in a particular open position, the pin 15 enters one of the holding notches 33 in the opposite edge 34 of the slot 16 in order to keep the jaws 4 and 5 in that particular position. It will be noted that the pin 15 is stationary with respect to the neck portion from which it extends and is preferably round but it can be made in a different shape. The pin 15 enters a notch 33 in the opposite edge 34 of the slot 16 by the action of the handle members 2 and 3 when they are moved toward each other. The pin 15 is disengaged from a notch 33 when the handle members 2 and 3 are moved away from each other.

A locking assembly is provided to ensure that the jaws 4 and 5 are held in a particular predetermined position around a the work piece W. The head portion 26 of the control arm 20 has a plurality of teeth 40 opposite the pin 22 on which the head portion 26 pivots. A lock-arm 41 is pivotally mounted on the second handle member 3 by a pin 42. The lock-arm 41 has a lock-point 43 extending therefrom toward the teeth 40 of the control arm 20. A finger piece 44 extends upwardly from the opposite end of the lock-arm 41 and extends beyond the edge of the handle member 3 in order to permit the user to manually move the lock-arm 41 back and forth on pivot 42. The lock-arm 41 has an indentation 46 which cooperates with a pair of spring-pressed moveable knobs 47 extending inwardly from the handle member 3 so that the lock-arm 41 is held in either its forward or rearward position. The lock-arm 41 (and its lock point 43) is biased towards the teeth 40 in control arm 20 by means of spring 45 urging it forward.

Figure 6:
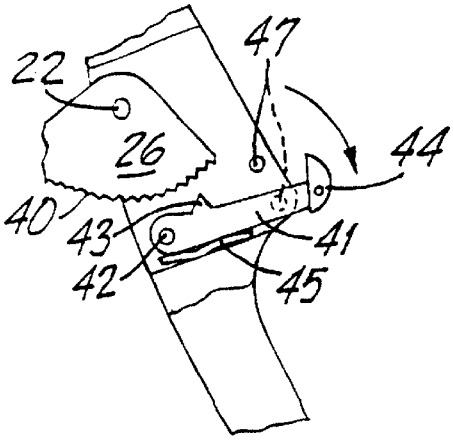
FIG. 6 is an enlarged fragmentary view showing a means for unlocking the jaws.
Figure 8:
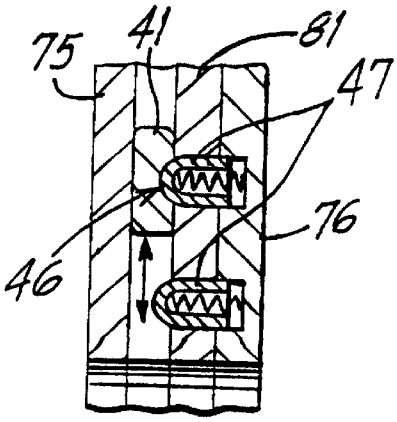
FIG. 8 is a sectional view taken along line 8—8 of FIG. 5.

When the jaw portions 4 and 5 are moved to grasp a work piece W the lock-arm 41 is manually moved forward as shown in FIG. 9 in order to cause its lock-point 43 to enter one of the teeth 40 in the head 26 of control arm 2. It is held in place by spring 45. This prevents the springs 30 and 31 from opening jaw portions 4 and 5 and locks the jaw portions 4 and 5 in a particular position around the work piece W. To open the jaw portions 4 and 5, the lock-arm 41 is moved manually back to the position shown in FIG. 6. This now removes the lock-point 43 from the teeth 40 in the control arm 20, permitting the springs 30 and 31 to contract and open the jaw portions 4 and 5. If desired, the lock-arm 41 may also be manually moved forward to place the lock point 43 into one of the teeth 40 before the jaw portions 4–5 are pressed together so that when the handle members 2–3 are pressed together the lock-point 43 rides over the various teeth 40 in the head 26 until the jaws close around a work piece W, at which time the lock-point 43 enters a tooth 40 to lock the jaw portions 4 and 5 in position. Hence, the user may lock and unlock the jaw portions 4 and 5 with one hand, thereby leaving the user's other hand free to perform some other function.

Figure 2:
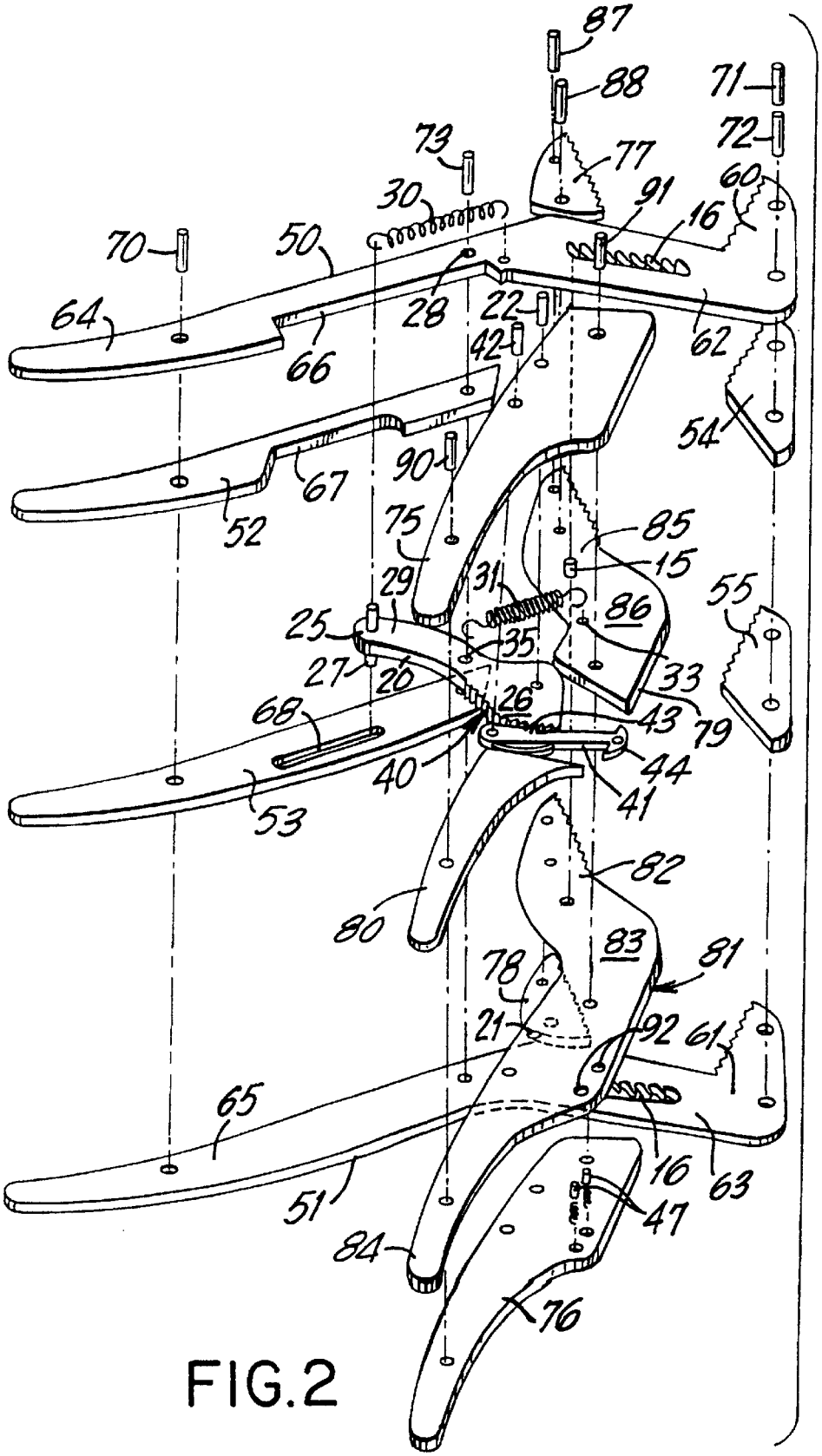
FIG. 2 is an exploded view showing a preferred construction of the adjustable plier shown in FIG. 1.

FIG. 2 shows the preferred structure of the handle members 2–3 and their component parts as being laminated. However, it will be understood that the handle members 2–3 may be made in one piece or in some other manner then that shown in the drawings without departing from the invention.

The first handle member 3 comprises a pair of one piece outer laminates 50 and 51, a pair of inner hand-grip laminates 52–53 and a pair of inner jaw laminates 54 and 55. The outer laminates 50 and 51 are shown as having jaw, neck and hand grip sections 60–61, 62–63, and 65–65 respectively. The inner jaw laminates 54 and 55 conforms to the contours of the jaw portions 60 and 61 of the outer laminates 50–51. The hand-grip portions of the inner laminates 52–53 conform in general to the contours of the hand-grip portions 64–65 of the outer laminates 50–51. It will be noted that the inner hand-grip laminates 52–53 and the inner jaw laminates 54–55 are interposed between the outer laminates 50–51 and are held in place by suitable pins 70, 71, 72 and 73. With this construction, the inner hand grip laminates 52 and 53 are longitudinally spaced from the inner portion laminates 54–55 to create the space 12 in the neck portion of the handle members 2 as shown in FIG. 1 and discussed above. The two outer laminates 50–51 each has an elongated slot 16 in neck portions 62. The pin 15 protrudes through both these slots 16. One of the outer laminates 50 has a cut-out 66 to permit the spring to rest therein, and to permit the pin 27 to move thereinalong. The outer laminate also has an opening 28 to hold one end of the spring 30. The inner laminate 52 adjacent said outer laminate 50 also has a cut-out slot 67 therein which is deeper than the slot 66 of the outer laminate 52 to permit the end 25 of the control arm 20 to ride therein. The other inner laminate 53 has a closed slot 68 into which the pin 27 of the control arm 20 enters and is held therein and permitted to move therein. With this construction, the pin 27 can move up and down within the slot 68 and the end 25 of the control arm 20 is held in place between inner laminate 53 and outer laminate 50 while riding in the slot 67.

The second handle member 3 comprises a pair of hand grip outer laminates 75 and 76, a pair of outer jaw laminates 77 and 78, a inner laminate 79 an inner hand grip laminate 80 and an elongated full size inner laminate 81. The hand grip's outer laminates 75–76 conform to the hand-grip portions 7 of the second handle member 3. The outer jaw laminates 77–78 conform in shape to the jaw portion 4 of the second handle member 3. The elongated fill size inner laminate has a jaw portion 82 a neck portion 83 and a hand grip portion 84. which conforms in shape to the shape of the second handle member 3. The inner jaw laminate has a jaw portion 85 and a neck portion 86. The laminates 77 to 86 are mounted together by suitable pins, 87, 88, 42, 22, 90 and 91. It will be noted that there is a space between the outer jaw laminate portions 77–78 and the outer hand grip laminates 75–76. This permits the neck portions 62–64 of the outer laminates 50–57 of the first handle member 2 to lie or move therebetween when the tool is assembled. It will also be noted that there is a space between the inner jaw laminate 79 and the hand-grip laminate 80. This will permit the control arm 20 and the lock-arm 41 to be mounted and to move therewithin. The first jaw laminate 79 and the full size laminate 81 have openings 33 therewithin to accommodate one end of the spring 31. The other end is accommodated in the opening 32 in the control arm 20. It will also be noted that the lock-arm 41 as well as the enlarged head 26 of the control arm 20 and the pressure spring 45 all lie within that same space. The spring-pressed lock knobs 47 are mounted in openings in the outer handgrip laminate 76 and extend through openings 92 in the full size laminate 81 and into the space between the inner jaw laminate 79 and the hand grip laminate 80 so that they will protrude into the indentation 46 in the lock-arm 41 to hold the lock-arms in place.

With this construction it will be seen that when the jaws are to be locked onto a work-piece W (FIG. 9) the jaws 4 and 5 are pushed together by squeezing the handle grips 2 and 3 so that the pin 15 slides along slot 16 until the jaw portions 4–5 are stopped around the work piece W. At this point the pin 15 in the neck portion 9 enters a notch 33 in the other neck portion 8 to hold the jaws 4 and 5 together. To ensure that the jaws 4 and 5 are locked in place, the lock-arm 41 is manually moved forward so that the lock-point 43 of the lock arm 41 is inserted into one of the teeth 40 in the head portion 26 in control arm 20 to lock the jaw portions 4 and 5 in that particular position. With this movement, the springs 30–31 are expanded or stretched. The lock-arm 41 is held in place by the lock-knobs 47 in indentation 46 and by the lock spring 45. Alternatively, before the handles 2 and 3 are squeezed, the lock-arm 41 may be manually moved forward to place its lock-point 43 into one of the teeth 40 and is held there by the leaf-spring 45. When the jaw portions 4 and 5 are closed around the work piece W the lock-point 43 will move along the teeth 40 of the control arm 20 until the closing of the jaw portions 4 and 5 is stopped at which point the lockpoint 43 enters a tooth 40 in the head 26 and locks the jaw portions 4 and 5 in place. To open the jaw portions 4 and 5, the lock arm 41 is manually moved away from the head 26 to move the lock-point 43 out of a tooth 40 in head 26. The springs 30–31 contract and the jaws spring open.

It will be thus be seen that the present invention provides an improved adjustable pliers which can be locked in any position with one hand and which does not require the use of two hands, which may be automatically locked in position and automatically opened, which may be locked easily in a particular position and easily unlocked from a particular position and which is simple and inexpensive to manufacture and simple to use.

As many and varied modifications of the subject matter of this invention will become apparent to those skilled in the art from the detailed description given hereinabove, it will be understood that the present invention is limited only as provided in the claims appended hereto.

What is claimed is:

1. Adjustable pliers comprising a pair of handle members, each handle member having a jaw portion, an intermediate portion and a hand-grip portion, said jaw, intermediate and hand-grip portions being rigidly connected together, each of said intermediate portions having a side surface, said handle members intersecting each other and being pivotally mounted to each other whereby movement of the hand grip portions in one direction will move the jaw portions in the same direction, stationary holding means extending from the side surface of one of said intermediate portions, a slot in the side surface of the other of said intermediate portions, said holding means extending into the said slot, said holding means being slidable along the slot, said slot having receiving means adapted to receive the said holding means when the jaw portion are placed in a predetermined position, said holding means being spatially stationary with respect to the side surface of the intermediate portion from which it extends, said holding means comprising a fixed holding pin extending from the side surface of the intermediate portion, said slot being elongated and said receiving means comprising a plurality of notches to permit said holding pin to be received in one of said notches, spring means to open the jaw portions when the holding pin is moved out of a notch, a control arm assembly connecting the hand-grip portions, one end of the control arm assembly is pivotly mounted to one of the hand grip portions, the other end of the control arm assembly has a head portion which is pivotly mounted, to the other hand grip portion, said spring means being interposed between the control arm assembly and the handle members, a lock assembly mounted in one of the handle members in order to lock the jaw portions in position, said lock assembly comprising a lock-point means cooperating with the head portion of said control arm assembly in order to maintain the jaw portions in a particular position, the head portion of the control arm assembly having a plurality of indentations along its periphery, said indentations being adjacent to each other spring means being provided adjacent the lock-point means to bias the lock-point means toward the indentations to permit the lock-point means to enter at least one of said indentations in order to lock the jaw portions in position.

2. Adjustable pliers as set forth in claim 1 wherein said handle members comprise laminations mounted together.

3. Adjustable pliers as set forth in claim 1 wherein release means are provided to permit the lock-point means to be moved in the opposite direction to move it away from the indentations.

4. Adjustable pliers as set forth in claim 1 wherein restraining means are provided to restrain the lock-point means in its position toward or away from said indentations.

5. Adjustable pliers set forth in claim 3 wherein said release means extend beyond the handle member to permit manual movement of the lock-point means away from the indentations.

6. Adjustable pliers comprising a pair of handle members, each handle member having a jaw portion, an intermediate portion and a hand-grip portion, each of said intermediate portions having a side surface, said handle members intersecting each other and being pivotally mounted to each other whereby movement of the hand grip portions in one direction will move the jaw portions in the same direction, stationary guide means extending from the side surface of one of said intermediate portions, a slot in the side surface of the other of said intermediate portions, said guide means extending into the said slot, said guide means being slidable along the slot, said guide means being spatially stationary with respect to the side surface of the intermediate portion from which it extends, a control arm assembly connecting the hand grip portions together, one end of the control arm assembly is pivotly mounted to one hand grip portion and the other end of the control arm assembly has a head portion which is pivotly mounted to the other hand grip portion, spring means to bias the jaws to an open position, a lock assembly on one of said handle members to lock the jaw portions in position, said lock assembly comprising a lock-point means in cooperation with the head portion of said control arm assembly in order to maintain the jaw portions in a particular position, the head portion of said control arm assembly having a plurality of indentations along its periphery opposite said lock-point means, said indentations being adjacent to each other and wherein spring means are provided adjacent the lock-point means to move the lock-point means into one of said indentations in order to lock the jaw portions in position.

7. Adjustable pliers as set forth in claim 6 wherein release means are provided to permit the lock-point means to be moved in the opposite direction to move it away from the indentations.

8. Adjustable pliers as set forth in claim 6 wherein restraining means are provided to restrain the lock-point means in its position toward or away from the said indentations.

9. Adjustable pliers as set forth in claim 7 wherein said release means extend beyond the handle member to permit manual movement of the lock-point means away from the indentation.

10. Adjustable pliers as set forth in claim 6 where in said handle members comprise laminations mounted together.

* * * * *